US006712484B2

(12) United States Patent
Hsien

(10) Patent No.: US 6,712,484 B2
(45) Date of Patent: Mar. 30, 2004

(54) RATCHET WRENCH AND LIGHTING CIRCUIT

(76) Inventor: Chih-Ching Hsien, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 10/213,402

(22) Filed: Aug. 7, 2002

(65) Prior Publication Data

US 2003/0043574 A1 Mar. 6, 2003

(30) Foreign Application Priority Data

Sep. 4, 2001 (TW) ..... 87204697A01 U

(51) Int. Cl.[7] ..... B25B 23/18
(52) U.S. Cl. ..... 362/119; 81/60; 81/177.85
(58) Field of Search ..... 362/119, 120, 362/398, 109, 202, 205, 267; 81/62, 177.2, 177.85

(56) References Cited

U.S. PATENT DOCUMENTS 5,897,198 A * 4/1999 Hsieh ..... 362/119
6,006,632 A * 12/1999 Hsieh ..... 81/177.85
6,508,565 B2 * 1/2003 Wang ..... 362/119
6,527,404 B2 * 3/2003 Wong ..... 362/119

* cited by examiner

*Primary Examiner*—Sandra O'Shea
*Assistant Examiner*—Ali Alavi
(74) *Attorney, Agent, or Firm*—Alan D. Kamrath; Rider Bennett, LLP

(57) ABSTRACT

A ratchet wrench and lighting circuit arrangement includes a ratchet wrench, the ratchet wrench having a hollow ratchet driving member mounted in a box at one end thereof, a holder shell fitted into the ratchet driving member and detachably secured thereto by a screw joint, and a lighting circuit assembly installed in the holder shell and controlled to emit light through a lens at a bottom side of the ratchet driving member.

5 Claims, 6 Drawing Sheets

RATCHET WRENCH AND LIGHTING CIRCUIT

BACKGROUND OF THE INVENTION

The present invention relates to wrenches, and more specifically, to a ratchet wrench and lighting circuit arrangement, which enables the user to replace the lamp bulb or battery of the lighting circuit assembly easily.

FIG. 1 shows a lighting circuit assembly installed in a ratchet driving member for ratchet wrench according to the prior art. As illustrated, the ratchet driving member has a stepped center through hole. The lighting circuit assembly is installed in the stepped center through hole of the ratchet driving member, comprised of a lamp socket holding a lamp bulb, a metal conical spring, a mercury battery, a metal contact plate, and a switch. This arrangement is not durable in use because the parts of the lighting circuit assembly tend to be forced out of position when operating the ratchet wrench. In case the lamp bulb is damaged or the battery power of the mercury battery is low, it is difficult to remove the lighting circuit assembly from the ratchet driving member for a replacement. Further, when the socket coupled to the shaft of the ratchet driving member and attached to the workpiece, the light passage is blocked.

SUMMARY OF THE INVENTION

The present invention has been accomplished to provide a ratchet wrench and lighting circuit arrangement, which eliminates the aforesaid drawbacks. It is one object of the present invention to provide a ratchet wrench and lighting circuit arrangement, which is easy to install. It is another object of the present invention to provide a ratchet wrench and lighting circuit arrangement, which enables the user to replace the lamp bulb or the battery conveniently. It is still another object of the present invention to provide a ratchet wrench and lighting circuit arrangement, which provides good illumination when mounted with the socket and attached to the workpiece. According to one aspect of the present invention, the ratchet wrench and lighting circuit arrangement comprises a ratchet wrench, the ratchet wrench having a hollow ratchet driving member mounted in a box at one end thereof and a socket detachably coupled to the ratchet driving member, a holder shell fitted into the ratchet driving member and detachably secured thereto by a screw joint, and a lighting circuit assembly installed in the holder shell and controlled to emit light through a lens at a bottom side of the ratchet driving member. According to another aspect of the present invention, the socket has transverse through holes through which light passes to the outside of the socket when the socket coupled to the ratchet driving member and attached to the workpiece.

DETAILED DESCRIPTION OF THE PREFERRED EMBODIMENT

Figure 1:
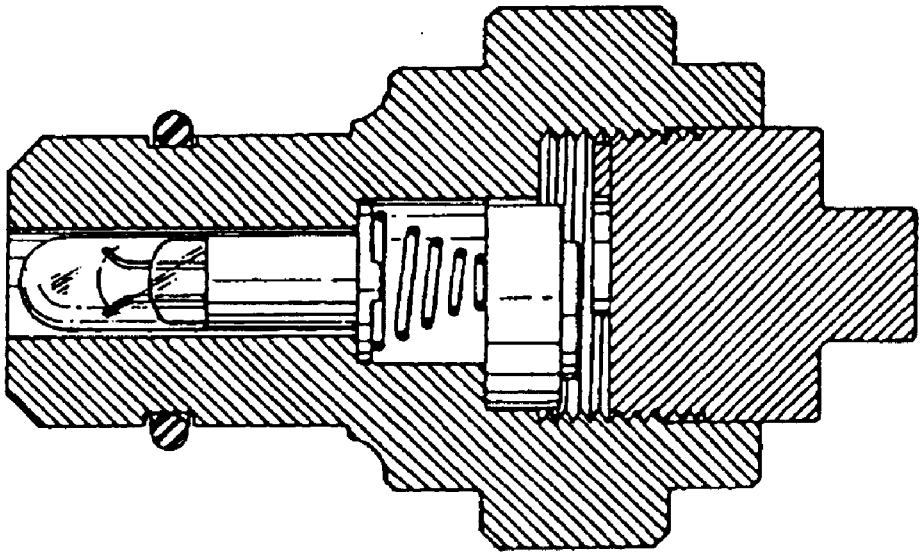
Fig . 1 PRIOR ART
FIG. 1 is a sectional view showing a lighting circuit assembly installed in a ratchet driving member for a ratchet wrench according to the prior art.
Figure 2:
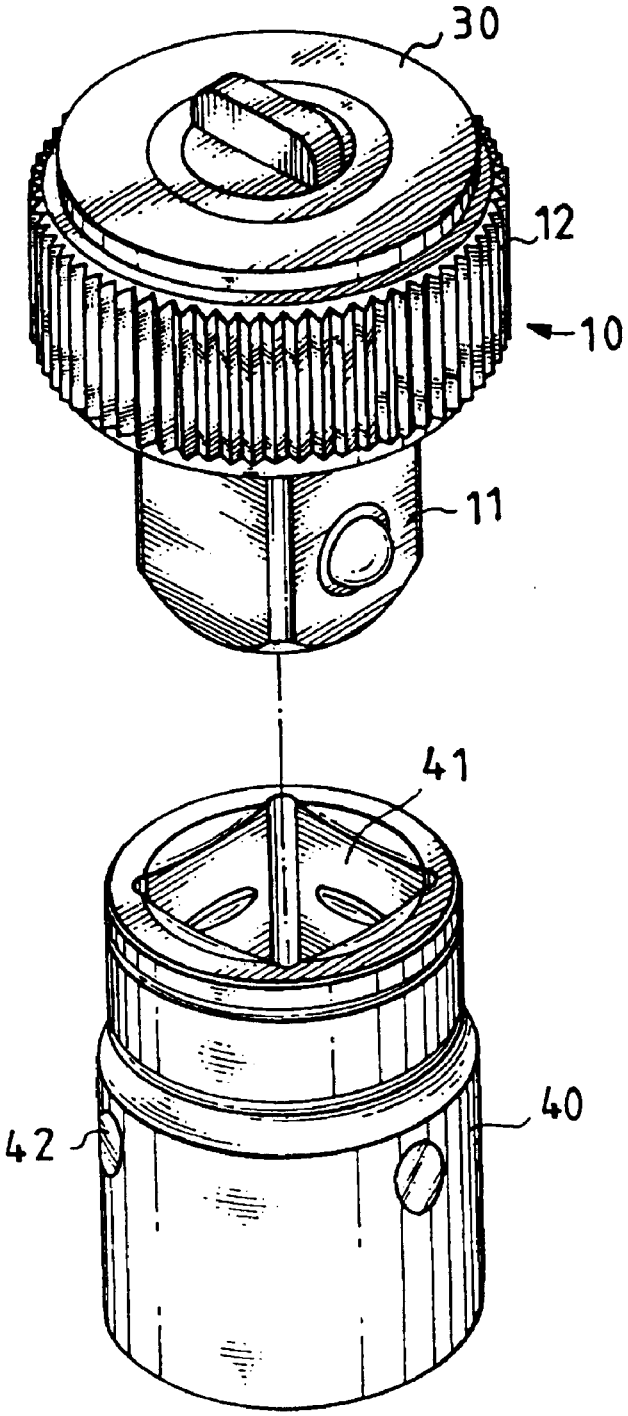
FIG. 2 is an elevational view of the present invention before the connection of the socket to the ratchet driving member.
Figure 3:
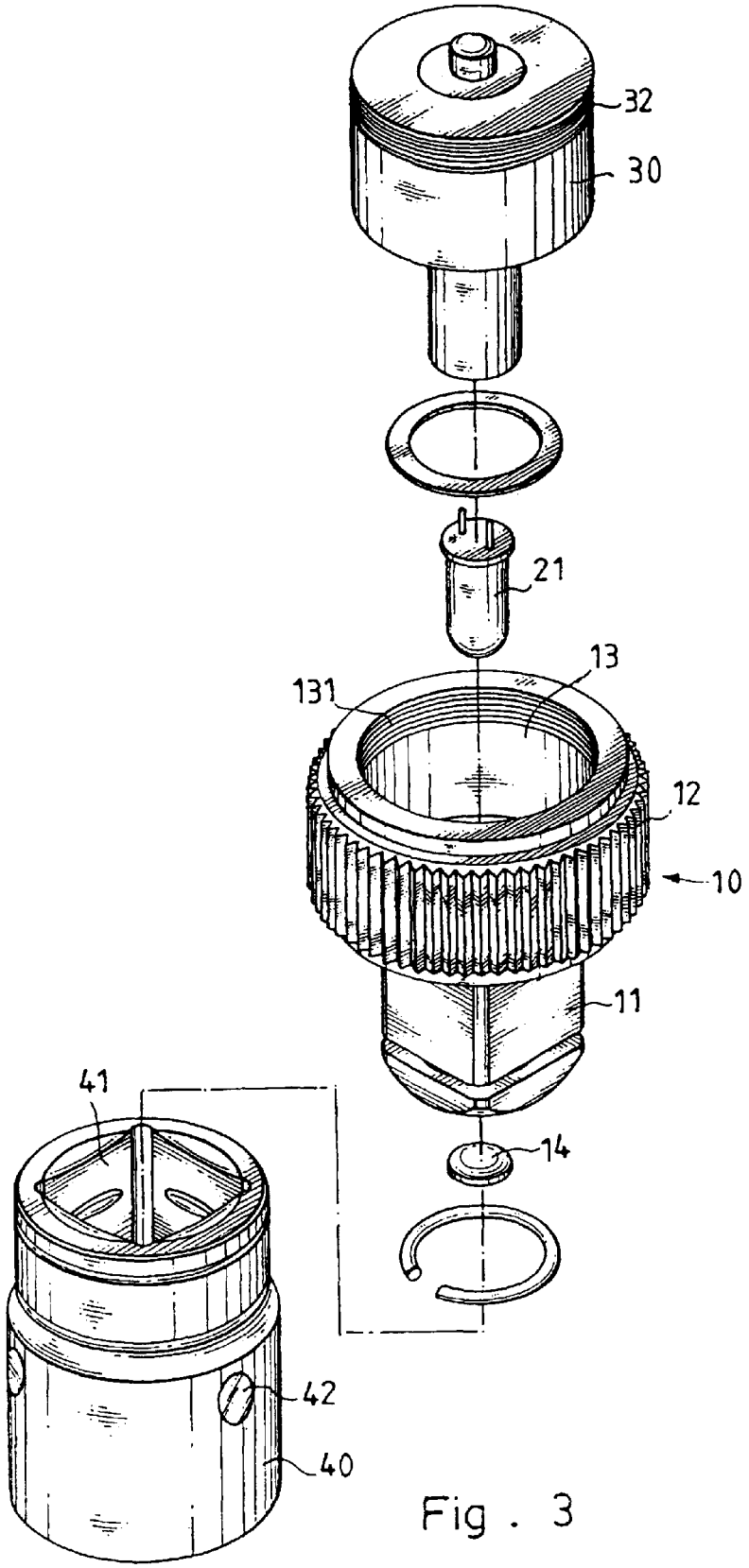
FIG. 3 is an exploded view of the present invention.
Figure 4:
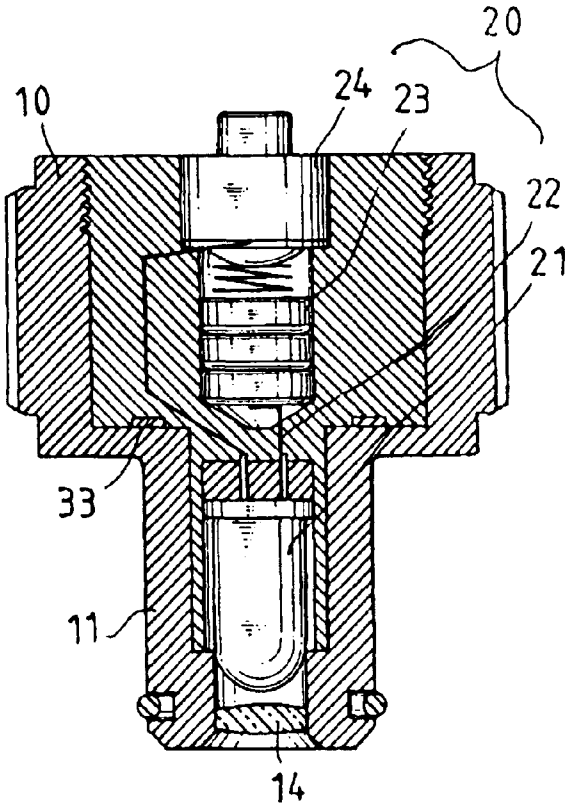
FIG. 4 is a sectional view of the present invention.
Figure 5:
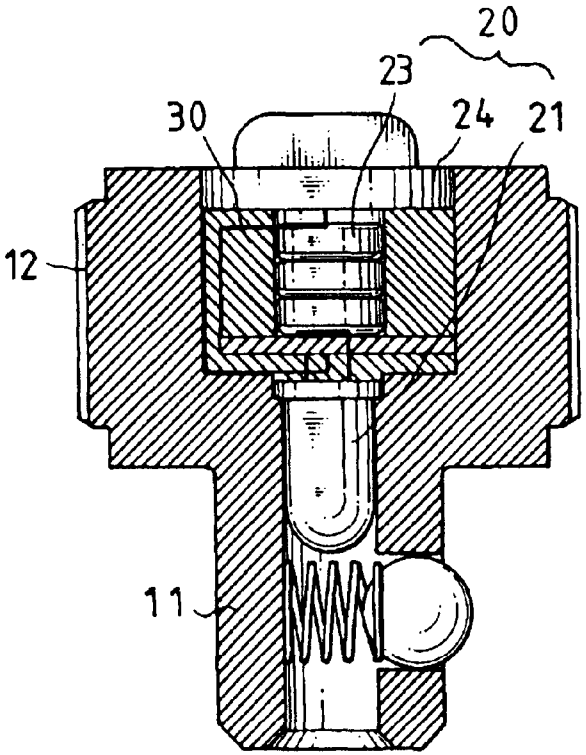
FIG. 5 is a sectional view of an alternate form of the present invention.
Figure 6:
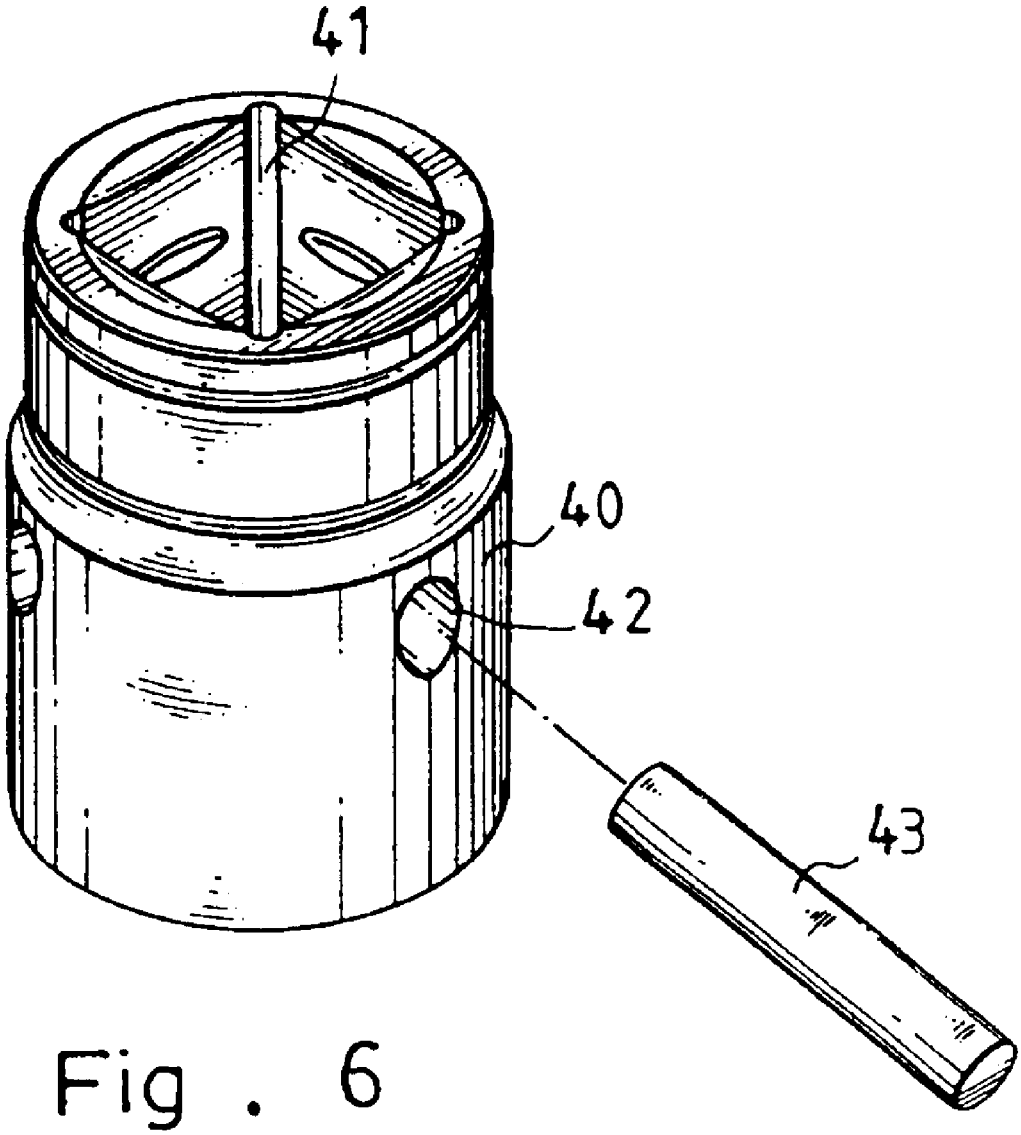
FIG. 6 illustrates the outer appearance of the socket according to the present invention.

Referring to FIGS. from 2 through 6, a ratchet wrench and lighting circuit arrangement in accordance with the present invention is generally comprised of a ratchet driving member 10, a lighting circuit assembly 20, a holder shell 30, and a socket 40.

The ratchet driving member 10 is a hollow stepped member mounted in the box of a wrench body (not shown) having a ratchet wheel 12, a polygonal shaft 11 axially extended from one side of the ratchet wheel 12, a stepped through hole 13 axially extended through the ratchet wheel 12 and the polygonal shaft 11, a lens 14 fixedly fastened to the polygonal shaft 11 at one end of the stepped through hole 13, and an inner thread 131 in the ratchet wheel 12 around the other end of the stepped through hole 13.

The lighting circuit assembly 20 is comprised of a lamp bulb 21, a metal contact plate 22, a mercury battery 23, and a switch 24.

The holder shell 30 fits the stepped through hole 13 of the ratchet driving member 10, having an axially extended open chamber 31, which holds the lighting circuit assembly 20, and an outer thread 32 threaded into the inner thread 131 of the ratchet driving member 10. Alternatively, a magnetic member 33 can be fixedly provided at a part of the holder shell 30, so that the holder shell 30 is secured in position by magnetic attraction when inserted into the stepped through hole 13 of the ratchet driving member 10 (The ratchet driving member 10 is made of metallic material attractive to magnet).

The socket 40 has an axially extended polygonal coupling hole 41 coupled to the polygonal shaft 11 of the ratchet driving member 10, and a plurality of transverse through holes 42 in communication with the axially extended polygonal coupling hole 41.

The lighting circuit assembly 20 is installed in the axially extended open chamber 31 of the holder shell 30 before the assembling the ratchet wrench. When assembling the ratchet wrench, the holder shell 30 is directly fastened to the stepped through hole 13 of the ratchet driving member 10. When the lamp bulb 21 is damaged, the holder shell 30 can easily be removed from the ratchet driving member 10 so that the user can replace the damaged lamp bulb 21.

When switched on the switch 24, light passes from the lamp bulb 21 through the lens 14 and then the transverse through holes 42 to the outside of the socket 40 to illuminate the working area around the workpiece. Further, the transverse through holes 42 may be respectively covered with a transparent or colored (acrylic) lens.

Figure 7:
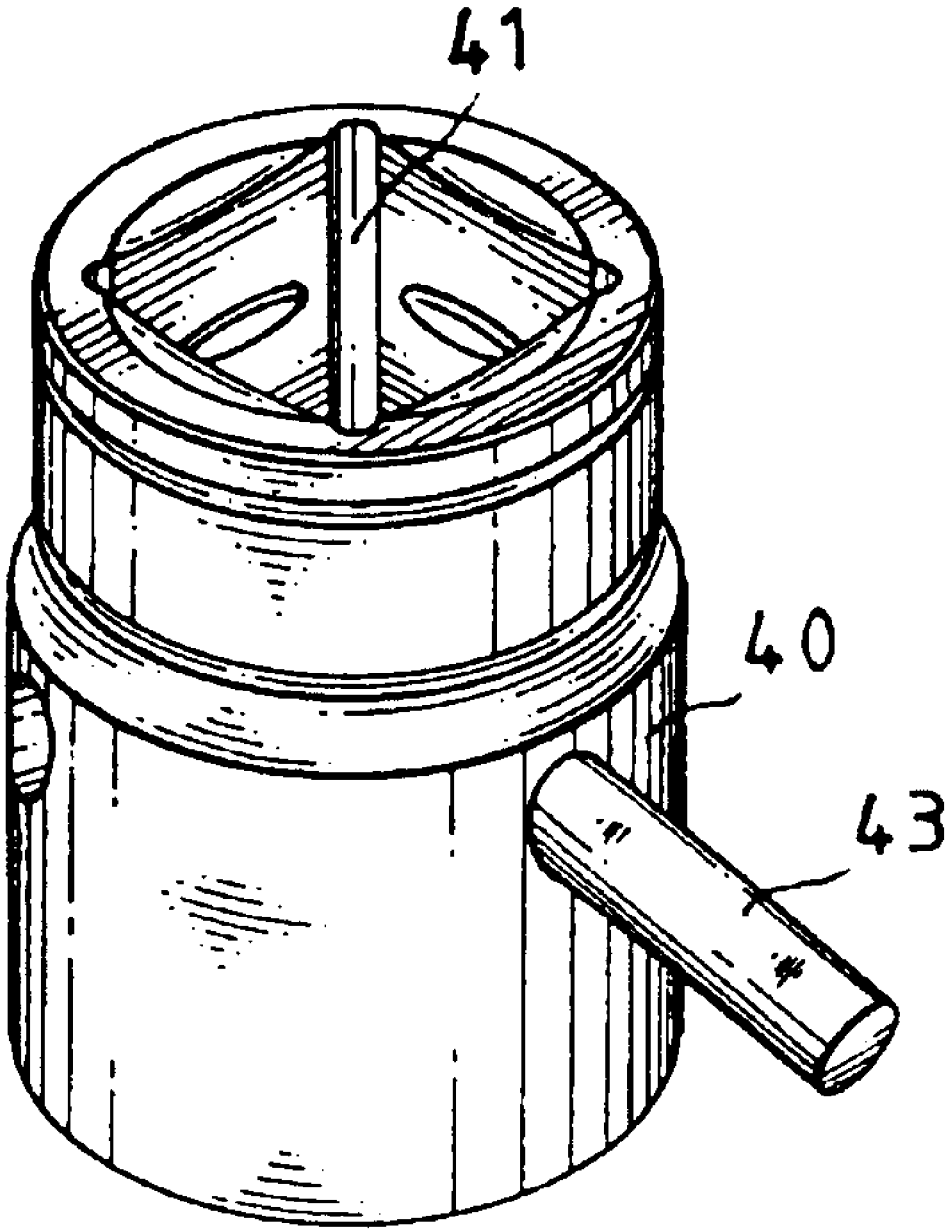
FIG. 7 shows the lever fastened to one transverse through hole of the socket according to the present invention.

Referring to FIG. 7, a lever 43 may be inserted into one transverse through hole 42 of the socket 40 for turning the socket 40 and the workpiece with the hand.

A prototype of ratchet wrench and lighting circuit arrangement has been constructed with the features of FIGS. 2~7. The ratchet wrench and lighting circuit arrangement functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A ratchet wrench and lighting circuit arrangement comprising a lighting circuit assembly, and a ratchet wrench holding said lighting circuit assembly, said ratchet wrench comprising a ratchet driving member, wherein said ratchet driving member comprises a stepped through hole, a holder shell fitted into said stepped through hole, and fastening means, which secures said bolder shell to said ratchet driving member, said holder shell having an axially extended open chamber, which holds said lighting circuit assembly, wherein said fastening means comprises a magnetic member fixedly mounted on said holder shell to attract said ratchet driving member.

2. The ratchet wrench and lighting circuit arrangement as claimed in claim 1 wherein said fastening means comprises an inner thread provided in the stepped through hole of said ratchet driving member, and an outer thread provided at said holder shell and threaded into said inner thread.

3. The ratchet wrench and lighting circuit arrangement as claimed in claim 1 wherein said ratchet driving member comprises a lens fastened to one end of said stepped through hole through which the light of said lighting circuit assembly passes to the outside of said ratchet driving member.

4. The ratchet wrench and lighting circuit arrangement as claimed in claim 1 further comprising a socket for coupling to said ratchet driving member to rotate a bolt or nut, said socket having transverse through holes through which the light passes from said lighting circuit assembly to the outside of said socket.

5. The ratchet wrench and lighting circuit arrangement as claimed in claim 4 further comprising a lever for insertion into one transverse through hole of said socket for turning said socket and the workpiece to which said socket is attached.

* * * * *